US010549408B2

(12) United States Patent
Choquette

(10) Patent No.: US 10,549,408 B2
(45) Date of Patent: Feb. 4, 2020

(54) HYDRANT VALVE REMOVAL TOOL AND IMPROVED KEYS THEREFORE

(71) Applicant: Steven Richard Choquette, Denver, CO (US)

(72) Inventor: Steven Richard Choquette, Denver, CO (US)

( * ) Notice: Subject to any disclaimer, the term of this patent is extended or adjusted under 35 U.S.C. 154(b) by 195 days.

(21) Appl. No.: 15/899,298

(22) Filed: Feb. 19, 2018

(65) Prior Publication Data

US 2019/0255686 A1 Aug. 22, 2019

(51) Int. Cl.
*B25B 17/02* (2006.01)
*B25B 13/48* (2006.01)
*B25B 13/06* (2006.01)

(52) U.S. Cl.
CPC ..... *B25B 17/02* (2013.01); *B25B 13/06* (2013.01); *B25B 13/48* (2013.01)

(58) Field of Classification Search
CPC ..... B25B 13/06; B25B 13/48; B25B 17/02; B25B 13/481
See application file for complete search history.

(56) References Cited

U.S. PATENT DOCUMENTS 3,199,384 A * 8/1965 Brase ..... B25B 17/02 81/57.31
3,768,775 A * 10/1973 Archer ..... F16K 27/00 251/230
4,178,816 A * 12/1979 Radice ..... B25B 17/02 251/248
4,815,345 A * 3/1989 Radice ..... B25B 13/48 81/44
6,364,285 B1 * 4/2002 Stinnett ..... F16K 31/46 251/293
6,776,068 B2 * 8/2004 Reuschel ..... B25B 13/48 81/54
8,915,675 B1 * 12/2014 Smith ..... F16L 55/18 138/97
2015/0202749 A1 * 7/2015 Sanders ..... B25B 17/02 81/57.24

* cited by examiner

*Primary Examiner* — David B. Thomas

(74) *Attorney, Agent, or Firm* — Craig W. Barber; Barber Legal

(57) ABSTRACT

A fire hydrant valve removal tool has a torque multiplier at the top end, a torque stabilizing bushing which keeps the transmission of torque straight from the top of the hydrant above ground to the valve in the bottom of the hydrant underground, a hydrant mounting adapter which at the lower end matches the flanges and holes of the hydrant so that the valve removal too may be bolted directly to the hydrant for stability, a drive which fits over the hydrant stem all the way down to the valve, and improved valve keys having a conical internal section allowing easy fitting over the hydrant stem. In addition the present invention teaches a rescue key which is designed to easily slide down into the valve body itself and apply torque to the guides/blades of the valve itself.

7 Claims, 8 Drawing Sheets

HYDRANT VALVE REMOVAL TOOL AND IMPROVED KEYS THEREFORE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

CROSS-REFERENCE TO RELATED APPLICATIONS

N/A

FIELD OF THE INVENTION

This invention relates generally to fire hydrant valves underground and specifically to an improved removal tool for underground valves of fire hydrants.

STATEMENT REGARDING FEDERALLY FUNDED RESEARCH

This invention was not made under contract with an agency of the US Government, nor by any agency of the US Government.

BACKGROUND OF THE INVENTION

The traditional dry fire hydrant has two important parts. Above ground, there is an upper standpipe or barrel body with one or more outlets/nozzles projecting from the sides. At the top end of the hydrant body is a bonnet (or head or cap) having an operating nut/bolt: to use the hydrant the outlet caps (covering and protecting the outlets/nozzles) are removed so that the outlets are accessible, and the outlets are connected to one or more fire hoses, then the operating nut/bolt is turned to start the water flow.

The operating 'nut' connects to or is the head end of a long bar (the fire hydrant stem or fire hydrant rod) projecting straight down the length of the hydrant to the valve: thus the operating nut/bolt connects to the fire hydrant stem/rod, which runs down the interior of the standpipe/barrel and underground to the second major part of the hydrant: a main valve connected to a pressurized water main. This main valve is operated by the turning of the stem/rod: as the main valve is opened water can flood upward from the water main, through the valve, up through the underground portion of the barrel body (properly: the lower standpipe), the above ground portion (the upper standpipe) and then out via the outlets into the connected fire hoses.

Some portions may have gaskets between them.

The major problem with fire hydrants is not usually found at the bonnet end, which is easily accessible. The bonnet and operating nut and stem are secured to the standpipe body by numerous bolts through a flange. These bolts can usually be easily removed and the bonnet, nut, and other upper parts replaced if necessary, even including the upper standpipe, which may be damaged by vehicular impact or the like.

The main valve however sits underground, sometimes deep underground, with pressurized main water constantly pushing against the underside, in a location which is hard to access. Inevitably, valves sometimes corrode to the point that they no longer work and must be replaced.

The valve replacement however in itself is a major operation. Water is drained from the relevant section of the main or at least, the part of the main impacted by the defunct valve is sealed by water main isolation valves located elsewhere on the hydrant water system. The valve is threaded on the outer circumference so that it comes unseated from the threaded bushing/seat at the junction of the lower standpipe and water main, by applying torsion against a pair of projecting tabs ("ears"). However, the threads of course begin to seize up over the course of time, other parts such as the ears/tabs also begin to corrode away and inevitably it becomes hard to turn the valve to remove it from the water main.

And the tools to turn the main valve must be inserted from the top of the hydrant and then extended all the way down the upper and lower stand pipes (barrel) to the main valve to engage the 'ears'/tabs.

Most water districts (municipalities, utilities, counties, etc) try to check their hydrants frequently. In fact, hydrants normally have an annual inspection standard, but due to the obvious cost and difficulty of valve removal, maintenance may be infrequent. Some districts report that sometimes 50% of hydrants cannot even be serviced without digging them up out of the ground entirely. To avoid having to dig the hydrant up, workers will attempt to hook construction equipment or vehicles to the upper end of the valve removal tools and thus exert enormous torsion on them despite the long vertical offset from the main valve up to the equipment pulling horizontally above ground. This in turn results in tools breaking, injuries as the jury-rigged connection from construction equipment to tool falls apart and goes flying through the air, not to mention increased costs, hydrants being unavailable when needed by fire fighters and so on.

It would be preferable to provide an effective tool for applying torsion efficiently to a hydrant main valve deep underground.

It would further be preferable to provide an efficient valve key to apply pressure to the ears of the valve.

It would further be preferable to provide an efficient means to maintain straight application of torque to a valve set deep underground.

It would yet further be preferable to provide a rescue key for use in situations in which the valve key cannot even mechanically engage the ears at all.

SUMMARY OF THE INVENTION

General Summary

The present invention teaches a fire hydrant valve removal tool which has the following key features: a torque multiplier at the top end so that greater torque may be applied without the use of construction equipment, vehicles and the like, a torque stabilizing bushing which keeps the transmission of torque straight from the top of the hydrant above ground to the valve in the bottom of the hydrant underground, a hydrant mounting adapter which at the lower end matches the flanges and holes of any one particular brand of hydrant so that the valve removal tool may be bolted directly to the hydrant for stability, an extension drive which fits over the hydrant stem all the way down to the valve, and improved valve keys having a conical internal section allowing easy fitting over the hydrant stem.

In addition the present invention teaches an improved "rescue" key which may be applied if the standard key fails to engage the ears/tabs projecting up from the periphery of the valve. This rescue key is designed to easily slide down into the valve body itself and apply torque to the guides (fins/blades) of the valve itself.

Summary in Reference to Claims

It is therefore another aspect, advantage, objective and embodiment of the invention, in addition to those discussed previously, to provide a hydrant valve removal tool, for use on a fire hydrant having a standpipe body having upper and lower ends, the standpipe body having at the upper end a hydrant flange and the hydrant flange having a plurality of bolt holes therethrough, the hydrant further having a fire hydrant stem having a stem diameter, a top end in the upper end of the standpipe body, the fire hydrant stem extending downward within the standpipe body to a valve, the valve having a valve body having guides thereon, the valve further having a plurality of peripheral ears projecting upward from the valve, the valve having peripheral threading which engages a threaded valve seat, the hydrant valve removal tool comprising:

a torque multiplier having a top bolt and a bottom bolt;

an extension drive socket, the extension drive socket having a top end dimensioned and configured to mechanically engage to the bottom bolt and mechanically engaged thereto, the extension drive socket having a bottom end dimensioned and configured to mechanically engage to a drive extension;

the drive extension having an elongated hollow body with an inner diameter greater than such fire hydrant stem diameter, the drive extension having a lower end and an upper end, the upper end mechanically engaged to the extension drive socket bottom end;

a valve key having a hollow body with an inner diameter greater than such fire hydrant stem diameter, the valve key having a head end dimensioned and configured to engage to the lower end of the drive extension and mechanically engaged thereto, the valve key having a tail end dimensioned and configured to mechanically engage to such valve, the valve key hollow body having a conical internal shape wider at the tail end and narrower at the head end;

whereby the valve key and drive extension may be placed over such top end of such fire hydrant stem and slid downward to such valve and rotated until it mechanically engages such valve, and then a torsional force may be applied from the torque multiplier via the extension drive socket, drive extension, and valve key to such valve.

It is therefore another aspect, advantage, objective and embodiment of the invention, in addition to those discussed previously, to provide a hydrant valve removal tool, wherein the valve key tail end further comprises:

a plurality of notches, dimensioned and configured to engage to such plurality of peripheral ears projecting upward from such valve.

It is therefore another aspect, advantage, objective and embodiment of the invention, in addition to those discussed previously, to provide a hydrant valve removal tool, wherein the valve key tail end further comprises:

a plurality of projections dimensioned and configured to engage to such guides on such valve;

each such projection having a curved first side and a straight second side.

It is therefore another aspect, advantage, objective and embodiment of the invention, in addition to those discussed previously, to provide a hydrant valve removal tool further comprising:

a retaining box having a top plate, a bottom plate and an interior;

the top plate having a top plate hole therethrough;

the bottom plate having a bottom plate hole therethrough;

the torque multiplier disposed within the retaining box with the top bolt projecting from the top plate hole and the bottom bolt projecting from the bottom plate hole.

It is therefore another aspect, advantage, objective and embodiment of the invention, in addition to those discussed previously, to provide a hydrant valve removal tool further comprising:

a reactionary box attached to the bottom plate with the bottom bolt projecting into an interior of the reactionary box;

the reactionary box having a plurality of reactionary pins projecting downward from the reactionary box;

a reactionary box bottom plate having a plurality of holes dimensioned and configured to allow the plurality of reactionary pins to project through the reactionary box bottom plate;

the reactionary box bottom plate having a drive hole therethrough, whereby the extension drive socket may mechanically engage the bottom bolt.

It is therefore another aspect, advantage, objective and embodiment of the invention, in addition to those discussed previously, to provide a hydrant valve removal tool further comprising:

an adaptor having a cylindrical body;

the cylindrical body having a top end and a bottom end, the top end having a top flange having plurality of holes dimensioned and configured to allow the plurality of reactionary pins projecting from the reactionary box bottom plate to further project through the top flange;

the bottom end of the cylindrical body of the adaptor having a bottom flange, the bottom flange having a plurality of holes dimensioned and configured to match such plurality of bolt holes through such hydrant flange; and a plurality of fasteners disposed through the bottom flange and such plurality of bolt holes through such hydrant flange, whereby the adaptor is secured to such hydrant.

It is therefore another aspect, advantage, objective and embodiment of the invention, in addition to those discussed previously, to provide a hydrant valve removal tool wherein the reactionary box bottom plate drive hole further comprises:

a bushing dimensioned and configured to stabilize the extension drive socket under torsion.

INDEX TO REFERENCE NUMERALS

Figure 1:
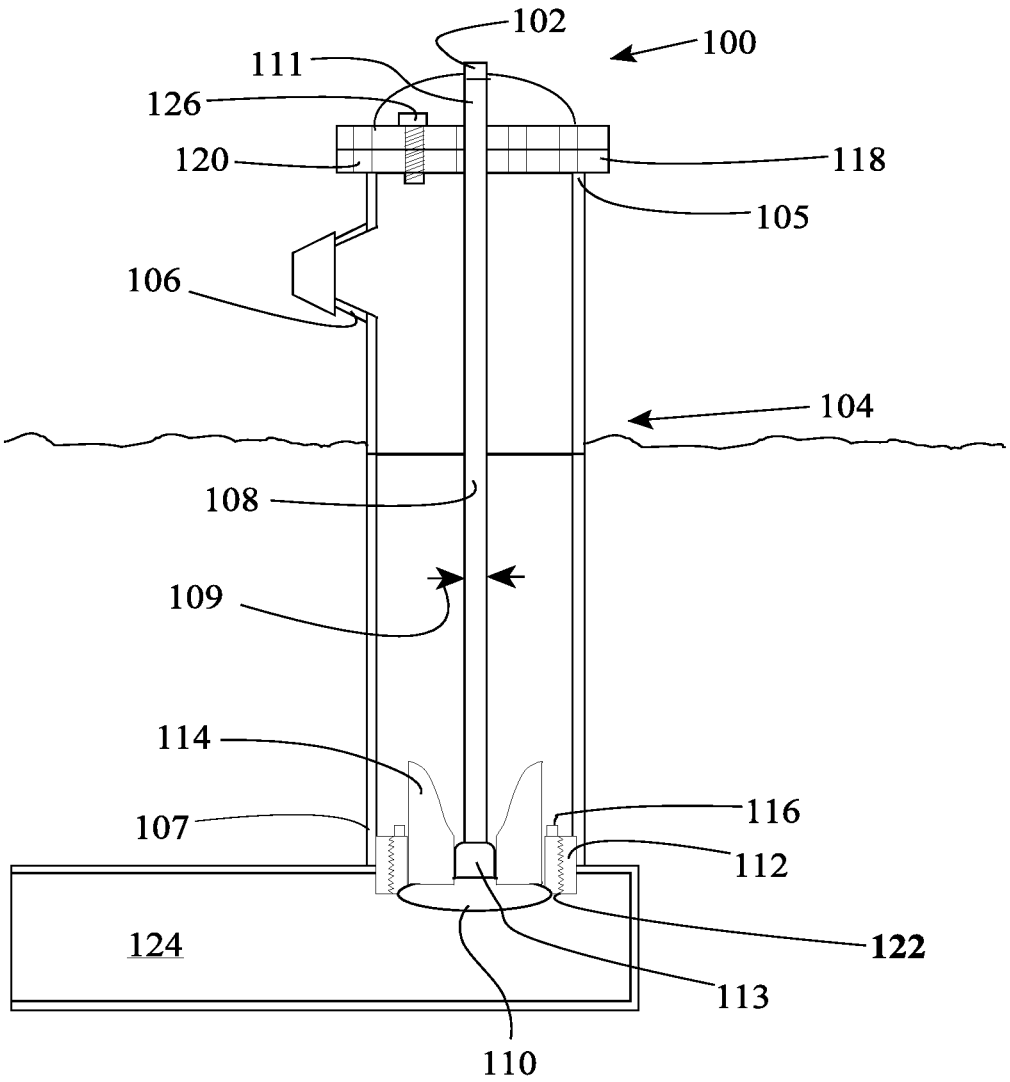
Fig. 1 PRIOR ART
FIG. 1 is a side view cross-sectional drawing of a first embodiment of the invention showing a PRIOR ART dry hydrant simplified.

Hydrant 100
Operating nut 102
Barrel/standpipe 104
Upper end 105
Nozzle/outlet 106
Standpipe lower end 107
Fire hydrant stem 108
Fire hydrant stem diameter 109
Valve body/ball 110
Rod upper end 111
Valve seat 112
Rod lower end 113
Valve guides 114
Valve ears 116
Hydrant flange 118
Hydrant flange holes 120
Threading on valve and water main 122
Water main 124
Removal tool 200
Torsional force 201
Valve removal key 202
Top bolt/torque multiplier input drive 203
Top plate 204
Top plate hole 205
Upper thrust washer/Torrington bearing 206
Torque multiplier 208
Bottom bolt/torque multiplier output drive 209
Lower thrust washer/bearing 210
Retaining box 212
Retaining box interior 213
Bottom plate 214
Bottom plate drive hole 215
Reactionary box 216
Reactionary box interior 217
Reactionary pins 218
Reactionary box bottom plate 220
Plate holes for reactionary pins to adapter 222
Reactionary box bottom plate drive hole 223
Hole for drive/extension 224
Torque stabilizing bushing 226
Extension drive socket 227
Drive extension (short in some drawings) 228
Hollow body inner diameter 229
Drive socket top end 230
Drive socket bottom end 232
Drive extension upper end 234
Drive extension lower end 236
Tool to hydrant adapter 400
Adapter barrel, hollow 402
Lower adapter flange to hydrant 404
Bolts, adaptor flange to hydrant flange 405
Adapter holes to hydrant flange 406
Upper adapter flange 408
Holes for reactionary pins 410
Upper (tool) end 412
Lower (hydrant) end 414
Valve key 500
Socket top to engage drive extension 502
Internally cone shaped body 504
Internal diameter 505
Notches engaging valve ears 506
Head end of key 508
Tail end of key 510
Rescue key 600
Socket top to engage drive extension 602
Internally cone shaped body 604
Internal diameter 605
Valve guide engaging extensions 606
Curved side 608
Straight side 610
Head end of rescue key 612
Tail end of rescue key 614
Part of opposite extension 616

DETAILED DESCRIPTION

Glossary

As used herein, a valve seat does not actually refer to the fixed (non-rotating) water barrier part of the valve itself, but instead refers to the threaded portion of a pipe into which the entire valve is screwed. Both meanings are sometimes used in technical jargon, so this distinction is made for clarity.

The term "hydrant" means a pressurized, dry standpipe, fire hydrant of conventional design.

Glossary End

FIG. 1 is a side view cross-sectional drawing of a first embodiment of the invention showing a PRIOR ART dry hydrant simplified.

Hydrant 100 has a bonnet on the top (the part above flange 118) crowned by operating nut 102. Operating nut 102 may have a pentagonal planform in order to discourage casual use by the public. The operating nut 102 is the part which firemen turn to control the flow of water, much like the taps of a domestic sink. Outlet 106 is the part from which water flows, like the faucet of a household sink: the fire hose is connected to outlet 106.

Standpipe 104 is the body of the hydrant. It may have more than one outlet, but usually has only one operating nut 102. Standpipe 104 is not just the visible part above ground, the upper end 105, it also extends down into the ground to the water main 124. Water main 124 may be a considerable distance underground, depths of 20 feet are not uncommon. This is part of the reason that replacing corroded valves without digging up the hydrant is so important.

Fire hydrant stem extends from the upper standpipe 105 down through the lower standpipe to the standpipe lower end 107. Fire hydrant stem 108 has an upper end 111 which may be connected to the operating nut 102 in the upper barrel/standpipe 105 or elsewhere in the barrel/standpipe 104. When operating nut 102 is turned, the stem 108 lower end 113 turns the valve 110 located at the junction of the main 124 and the standpipe lower end 107.

Fire hydrant stem diameter 109 is important as parts of the invention will be dimensioned and configured to pass over the stem, that is, have inner diameters greater than the stem diameter 109.

Valve body/ball 110 has a threaded periphery 122: the threading on the valve seat (located at the water main) and the threading on the valve allow it to be mechanically engaged in a firm and water-tight manner, despite the pressurization of the water main 124.

However, threading 122 which joins the valve 110 to the main 124 is a constant source of problems which this invention is designed to overcome. The threading seizes in the course of time, due to corrosion, dirt entering the standpipe, contaminants in the water, dielectric currents between the water and the various metals, freezes and thaws if the valve 110 is not below the frost line and so on.

When the threading 122 between the valve 110 and the valve seat 112 seizes, the valve can no longer be easily turned for maintenance, or even fails to seat properly, or fails to seal so that a persistent water leak ensues, underground where it. Guides 114 (the valve's projecting guides or blade-like structures) are part of the operant valve body allowing water to flow past them (the guides extend upward with spaces about them).

Valve ears 116 on the other hand are part of the non-rotating part of the valve which is threaded. This part of the valve is not supposed to turn when the valve is opened or closed. However, the ears or tabs 116 provide a purchase for workers to turn the entire valve, rather than opening it, when removing or replacing it. Note however that the ears can be deformed due to handling before or after installation, the ears are also subject to corrosion, buildup of dirt and so on. This is another source of problems when removing a valve.

Returning to the top end of the hydrant, flange 118 allows the bonnet of the hydrant to be fastened down with a number of fasteners 126 (usually bolts passing through the holes in flange of the bonnet, the flange holes 120, and then threaded into nuts underneath the flanges).

The number of bolt holes 120, the size of the flange, the diameter of the standpipe, the diameter of the bolts 126 and the holes 120 all may vary depending on make and model of hydrant. Thus, it is one aspect, advantage and embodiment of the invention to provide interchangeable adapter parts allowing the invention to be used with different types of hydrants merely by using the proper type of adapter.

Figure 2:
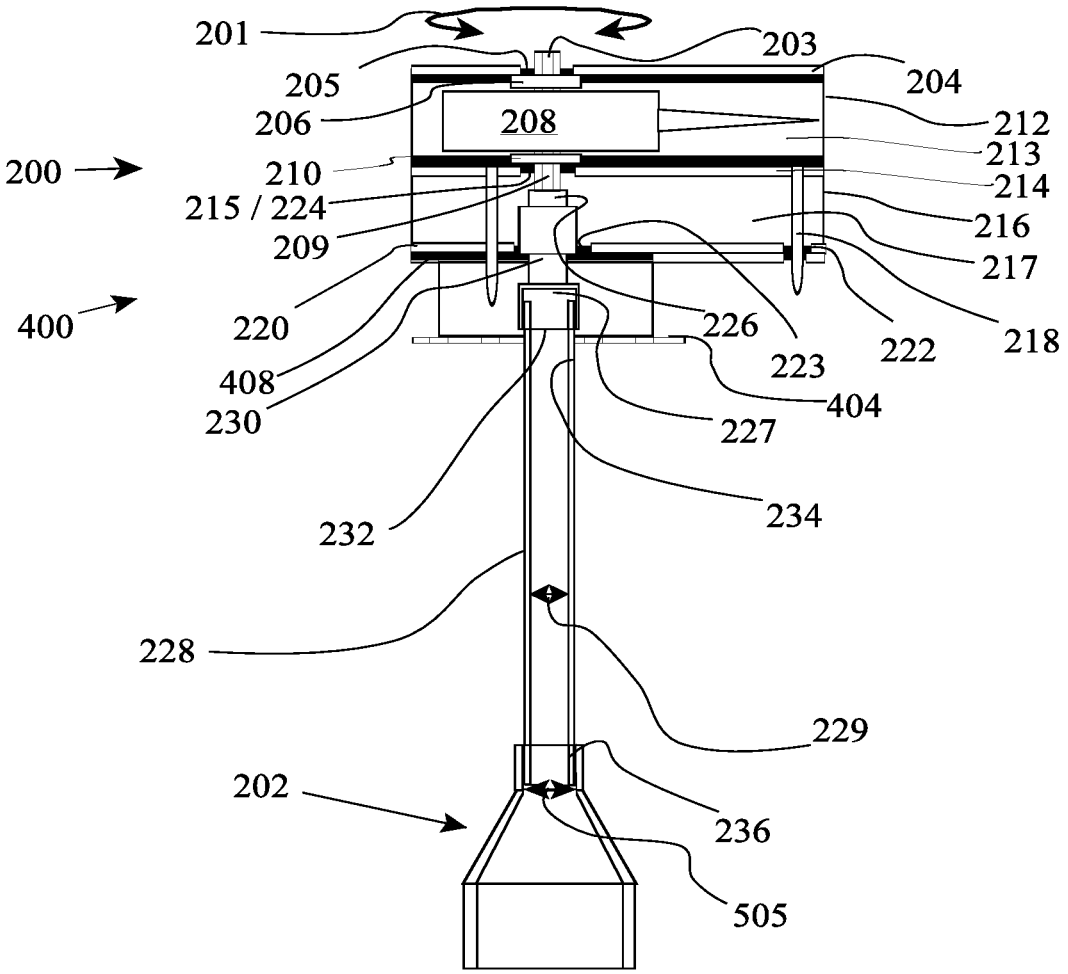
FIG. 2 is a side view of the present invention with a valve key on the lower end.

FIG. 2 is a side view of the present invention with a valve key on the lower end. Removal tool 200 sits atop adapter 400, with the extension 228 passing through the adapter 400 and continuing downward to key 202.

Extension 228 is shown as a single short body due to diagraming limitations, but in fact it has been found to be helpful if it has various lengths and various connectors so that it can be assembled piece by piece as it is slid down a hydrant standpipe.

Torsional force 201 is applied to the top drive bolt 203 (the torque input bolt) which is part of a torque multiplier 208. The top drive bolt 203 projects through a top plate 204 by way of a top plate hole 205. Under top plate hole 205 is the upper thrust washer 206 which is one of several washers and bushings and retainers designed to keep torsion which is applied to the top bolt 203 straight in line.

Torque multiplier 208 may be any type of torque multiplier, for example a standard planetary gear arrangement. In testing 16X (multiplying torque by a factor of 16 times) is found to be the minimum desirable amount of torque increase (a minimum of 4X torque is found to be necessary but may not always be sufficient), that is, a torque multiplier which turns 720 degrees of rotation of top bolt 203 into only 45 degrees of rotation of bottom bolt 209 (the torque multiplier's output bolt), but with sixteen times as much torque on bottom bolt 209 as was applied to the top bolt. (Or 360 degrees of rotation of the top bolt (1complete revolution) and 22.5 degrees by the bottom bolt (one sixteenth of a revolution). Internal details of such torque multipliers (which are found on the market) are not claimed as details of the invention. This large torsional gain is required due to the extreme difficulty found in dealing with seized valves deep underground.

Lower thrust washer 210 and retaining box 212, as noted previously, are part of the system for keeping torque (torsional forces) applied in a straight line from top to bottom, from the top bolt 203 to the actual valve 110 far below. Obviously if parts begin to experience lateral torque, they may buckle, resulting in a lose of torsional force or even failure of some parts.

Retaining box interior 213 holds the torque multiplier, keeping it clean and safe.

Bottom plate 214 has a bottom plate drive hole 215 through which the bottom bolt 209 passes (via drive hole 224) into reactionary box 216 having reactionary box interior 217.

Reactionary box 216 is fastened by reactionary pins 218 (passing through reactionary box bottom plate 220 having plates holes 222 for the reactionary pins 218) to the adapter 400, which as will be discussed later is secured to the hydrant. Thus reactionary box 216 provides a fulcrum against which the torque multiplier may work.

Reactionary box bottom plate 220 has drive hole 223 for the drive socket or extension to pass through.

Torque stabilizing bushing 226 is another important part of the torque alignment structures of the fire hydrant removal tool. As noted previously, the hydrant may be quite deep and so the extension 228 must have torque applied very evenly and in a high degree of alignment with the extension. The stabilizing bushing 227 (seen surrounded by a bushing retainer, unnumbered) is the final piece of stability control before the long drop of the extension 228 down the standpipe of the hydrant.

Extension drive socket 227 (Not to be confused with the drive extension 228) has a drive socket top end 230 and a drive socket bottom end 232. Top end 230 connects to the bottom bolt 209, while the bottom end 232 is dimensioned and configured to connect to the drive extension 228 at drive extension upper end 234.

The drive extension 228 may have a hollow inner body. This hollow inner body may in turn have a diameter (or width if non-circular, for example, a square beam section) 229. Hollow body inner diameter 229 may be slightly larger than fire hydrant stem diameter 109.

It may be seen that the drive extension 228 may thus be lowered into the standpipe of the hydrant with a valve key attached to the drive extension lower end 236, and then slid downward with the fire hydrant stem 108 inside of the extension 228. This may provide a limited degree of stability, but more importantly it maintains a direct, even and straight torsion path from top to bottom of the tool and hydrant.

Figure 3A:
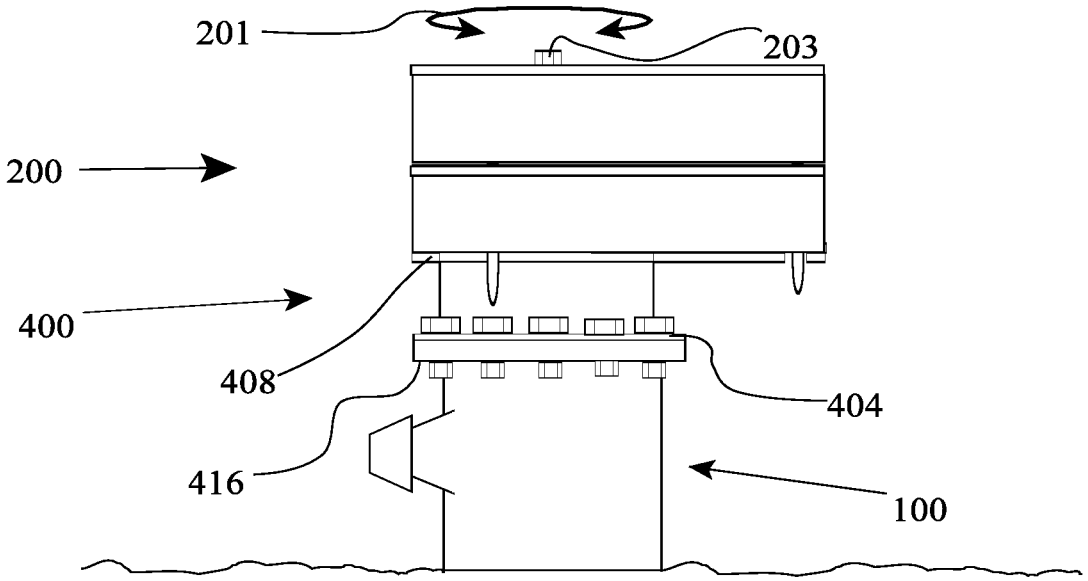
FIG. 3*a* is a side view of the present invention mounted on a fire hydrant.

FIG. 3*a* is a side view of the present invention mounted on a fire hydrant 100. Top bolt 203 will have torsion 201 applied (for example with a wrench or flex handle) as the removal tool 200 sits atop its adapter portion 400, with projecting reactionary pins keeping it aligned to the adapter 400 flange 408. The lower flange 404 of the adapter 400 is seen to be securely bolted to hydrant flange 416.

Figure 3B:
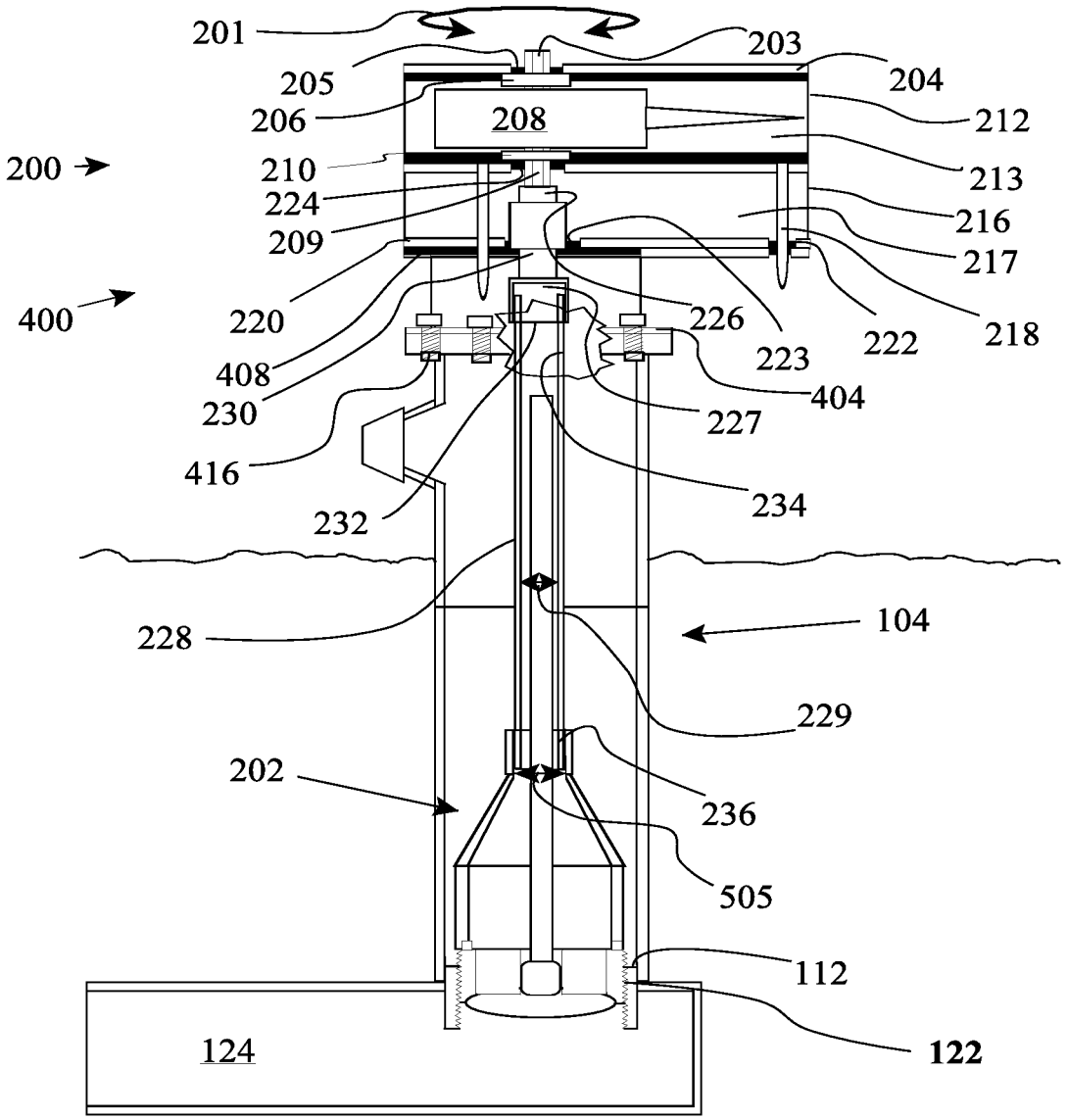
FIG. 3*b* is a cross-sectional side view of the present invention mounted upon a fire hydrant.

FIG. 3*b* is a cross-sectional side view of the present invention mounted upon a fire hydrant, showing the considerable internal complexity of the invention. As noted previously, top bolt 203 is turned, torque multiplier 208 reduces the angle of turn but increases the torque exerted at bolt 209, which turns the drive socket 227, which turns the extension 228, which turns the valve key 202, which turns the tabs on the periphery of the valve.

Part of the lower adapter flange 404 and the hydrant flange 416 and the bolts connecting them has been cutaway so that the extension and socket may be seen to be connected, extension inside of socket inside the standpipe 104 of the hydrant.

As shown, the torque has broken the threading 122 free and the valve has started to rise, unscrewing out of the valve seat 112. (Note that the threading scale shown is simplified for clarity, as is the scale of other parts of the various diagrams.)

Thrust washers 206 and 210 and bushing 226 are aiding maintaining the torsion in exact alignment.

Retaining box 212, reactionary box 214, reactionary pins 218, bolts, lower flange 404 and other plates and flanges are maintaining the device firmly secured to the hydrant. This is necessary as the high torque needed can cause equipment to flip off, possibly causing injury.

In this diagram the smallest inside diameter 505 of the valve key 202 and inside diameter 229 of the extension 228 may be seen: although one fits inside of the other, both are dimensioned and configured to allow the hydrant stem to pass within them.

Figure 4:
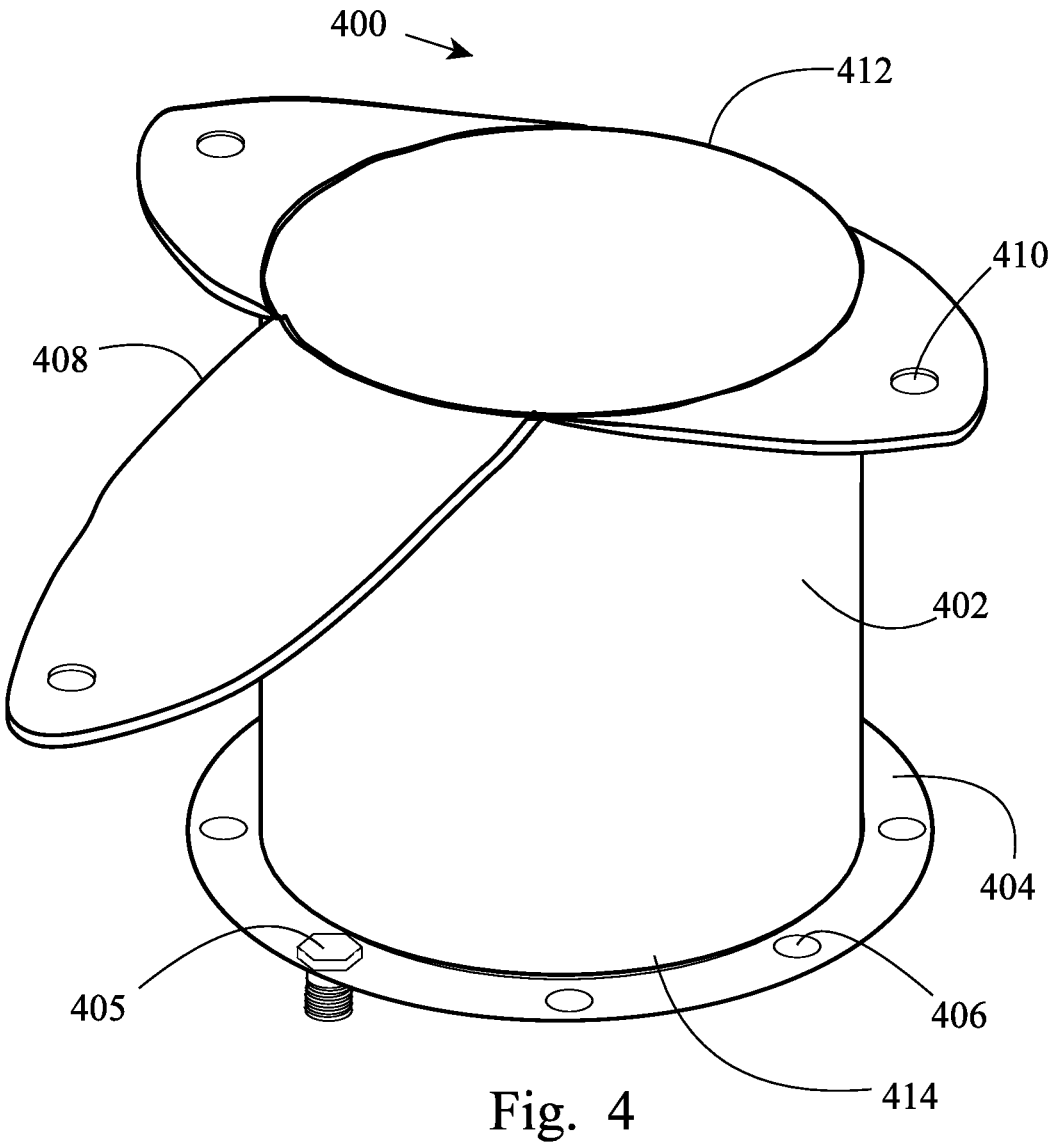
FIG. 4 is a hydrant mounting adaptor drawing shown in elevated orthogonal view.

FIG. 4 is a hydrant mounting adaptor drawing shown in elevated orthoganal view. It will immediately be seen that the arrangement of the various flanges of the adapter can be other than just a simple toroidal (doughnut) shape.

Tool to hydrant adapter 400 has a main body slightly similar to a hydrant: a cylindrical adapter standpipe which is hollow, 402. The lower adapter flange 404 connects it to hydrant 100. Bolts 405 pass through the lower adaptor flange 404 at holes 406 to the hydrant flange to secure them together.

Upper adapter flange 408 has a more complex shape comprising multiple partial flanges with holes 410 dimensioned and configured for reactionary pins to pass through.

Upper (tool) end 412 will be the base to which the reactionary box is attached, while the lower (hydrant) end 414 will be attached by the bolts 405 (only one is shown) to the hydrant flange.

Figure 5:
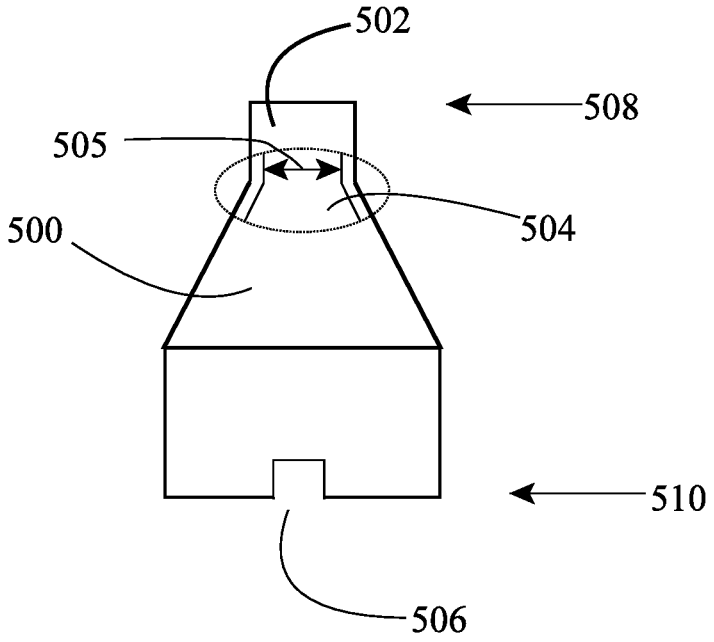
FIG. 5 is a valve key of the invention shown in side view.

FIG. 5 is a side view of a valve key of the invention. Valve key 500 has at the head end 508 a socket top 502 to engage the drive extension running down the inside of the hydrant. The head end 508, socket top 502, body 504, and tail end 510 are all hollow so that the key 500 may accept the fire hydrant stem and allow the stem to pass through and upward into the extension.

Internally cone shaped body 504 aids in aligning the body on the valve and on the stem. A partial cross-sectional view is shown so that the internal cone-shaped body 504 may be seen.

Minimum internal diameter 505 is greater than the stem diameter.

Notches 506 are dimensioned and configured to engaging valve ears/tabs as discussed elsewhere. Note that valve tabs/ears may vary in size and shape so different valve keys 500 may be employed.

Figure 6:
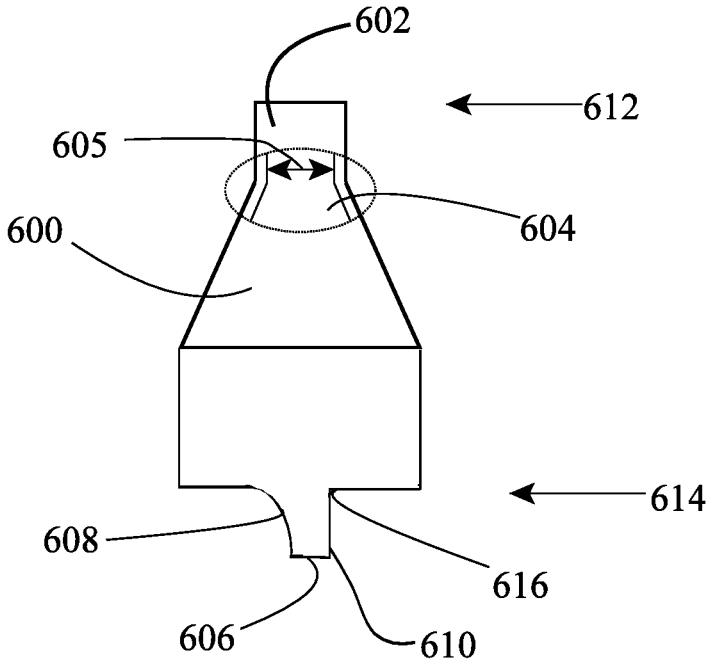
FIG. 6 is a rescue key of the invention shown in side view.

FIG. 6 is a side view of a rescue key of the invention. Rescue key 600 is similar to the regular key in some ways, for example, it is attached to the bottom end of the extension and operated by turning the top bolt in a manner similar to the operations with the key 500 in place. Valve key 600 has at the head end 612 a socket top 602 to engage the drive extension running down the inside of the hydrant. The head end 612, socket top 602, body 604, and tail end 614 are all hollow so that the key 600 may accept the fire hydrant stem and allow the stem to pass through and upward into the extension, and again internally cone shaped body 604 aids in aligning the body on the valve and on the stem. A partial cross-sectional view is shown so that the internal cone-shaped body 604 may be seen. And as with key 500, the key 600 has a minimum internal diameter 605 which is greater than the stem diameter.

However, rescue key 600 may be used when the key 500 fails to dislodge a valve which cannot come free from the water main threading. This may be due to extreme threading issues, deformed, damaged or corroded ears or for other reasons.

Instead of engaging to the ears/tabs, this rescue key 600 is dimensioned and configured to slide two blade-engaging extensions 606 downward into the main body of the valve, not the periphery. Thus for example rescue key 600 may in some alternatives be narrower than key 500, since the guides/blades are inward from the tabs/ears of the valve.

Curved side 608 of each blade-engagement extension 606 allows for easy rotation of the key 600 in a first direction until it slides down the guides. Thereafter the key 600 may be rotated the other way until straight side 610 engages with the guides. Since it is straight, side 610 will not tend to rise up when torque is applied and thus a firm push on the blades of the valve can be achieved even when the tabs/ears are not usable.

Note that another identical extension 616 is largely occluded by the nearer extension 606, however, a tiny part of the opposite extension 616 is barely visible. In other embodiments, there may be other arrangements of the extensions.

Figure 7:
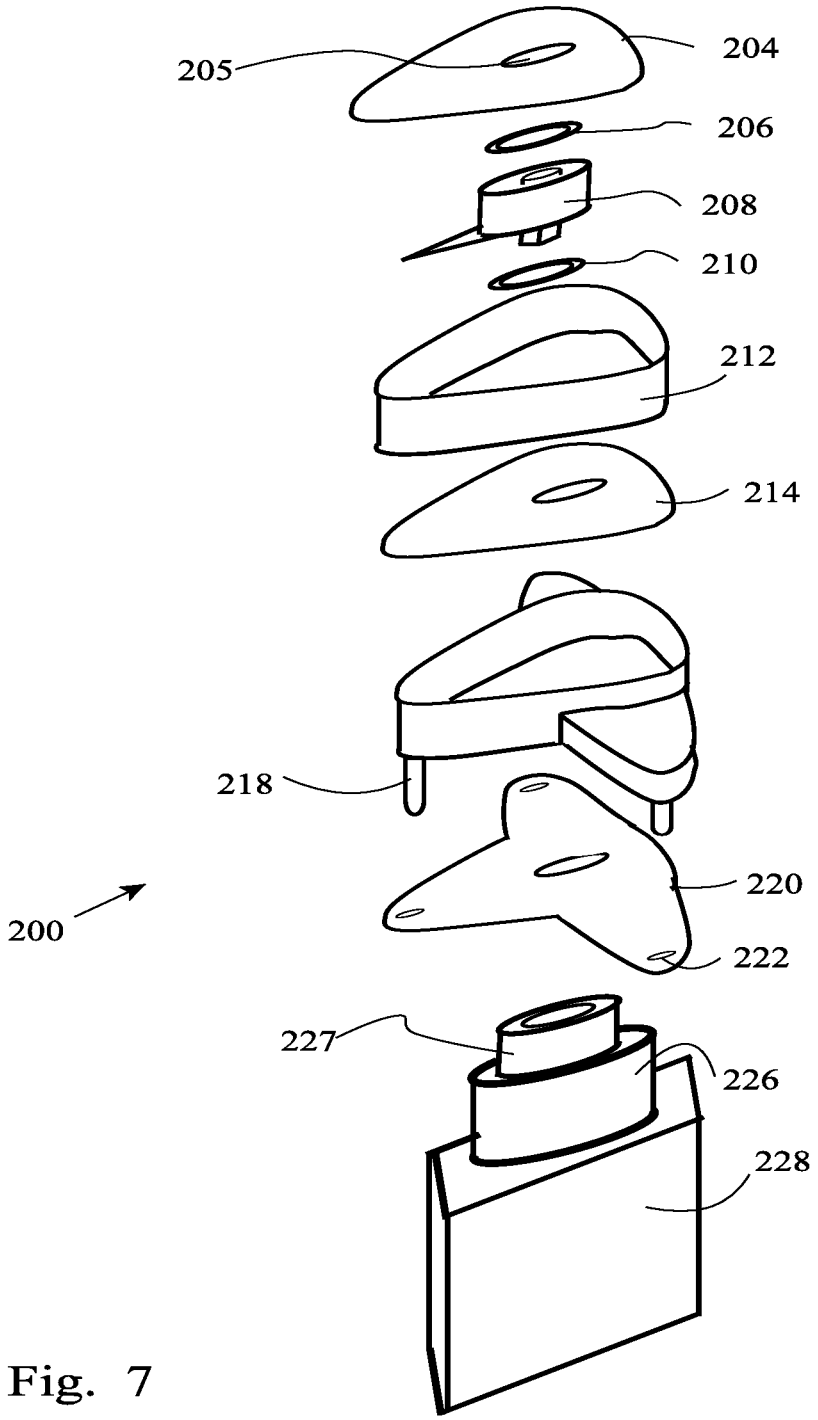
FIG. 7 is an exploded view of the invention in side view.

FIG. 7 is an exploded view of the invention in side view. Removal tool 200 has at one (bottom) end the valve removal key (not pictured here) and at the top end, the top bolt projecting from top plate 204 via top plate hole 205. Upper thrust washer 206 sits at the hole 205 above the torque multiplier 208, with the bottom bolt projecting downward through bottom plate 214 and lower thrust washer 210 into retaining box 212.

Reactionary pins 218 are part of the reactionary box 212 and pass through the reactionary box bottom plate 220 via plates holes 222 dimensioned and configured for the reactionary pins 218 to reach the adapter.

Reactionary box bottom plate drive hole 223 and the drive hole 224 allow the extension drive socket 227 to pass out and downward (through torque stabilizing bushing 226) to the drive extension 228.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventor intends these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles.

Techniques from any of the examples can be incorporated into one or more of any of the other examples. It is intended that the specification and examples be considered as exemplary only, with a true scope and spirit of the invention being indicated by the following claims.

What is claimed is:

1. A hydrant valve removal tool, for use on a fire hydrant having a standpipe body having upper and lower ends, the standpipe body having at the upper end a hydrant flange and the hydrant flange having a plurality of bolt holes therethrough, the hydrant further having a fire hydrant stem having a stem diameter, and a stem a top end in the upper end of the standpipe body, the fire hydrant stem extending downward within the standpipe body to a valve, the valve having a valve body having guides thereon, the valve further having a plurality of peripheral ears projecting upward from the valve, the valve having peripheral threading which engages a threaded valve seat, the hydrant valve removal tool comprising:

a torque multiplier having a top bolt and a bottom bolt;

an extension drive socket, the extension drive socket having a top end dimensioned and configured to mechanically engage to the bottom bolt and mechanically engaged thereto, the extension drive socket having a bottom end dimensioned and configured to mechanically engage to a drive extension;

the drive extension having an elongated hollow body with an inner diameter greater than such fire hydrant stem diameter, the drive extension having a lower end and an upper end, the upper end mechanically engaged to the extension drive socket bottom end;

a valve key having a hollow body with an inner diameter greater than such fire hydrant stem diameter, the valve key having a head end dimensioned and configured to engage to the lower end of the drive extension and mechanically engaged thereto, the valve key having a tail end dimensioned and configured to mechanically engage to such valve, the valve key hollow body having a conical internal shape wider at the tail end and narrower at the head end;

whereby the valve key and drive extension may be placed over such top end of such fire hydrant stem and slid downward to such valve and rotated until it mechanically engages such valve, and then a torsional force may be applied from the torque multiplier via the extension drive socket, drive extension, and valve key to such valve.

2. The hydrant valve removal tool of claim 1, wherein the valve key tail end further comprises:

a plurality of notches, dimensioned and configured to engage to such plurality of peripheral ears projecting upward from such valve.

3. The hydrant valve removal tool of claim 1, wherein the valve key tail end further comprises:

a plurality of projections dimensioned and configured to engage to such guides inside of such valve;

each such projection having a curved first side and a straight second side.

4. The hydrant valve removal tool of claim 1, further comprising:

a retaining box having a top plate, a bottom plate and an interior;

the top plate having a top plate hole therethrough;

the bottom plate having a bottom plate hole therethrough;

the torque multiplier disposed within the retaining box with the top bolt projecting from the top plate hole and the bottom bolt projecting from the bottom plate hole.

5. The hydrant valve removal tool of claim 4, further comprising:

a reactionary box attached to the bottom plate with the bottom bolt projecting into an interior of the reactionary box;

the reactionary box having a plurality of reactionary pins projecting downward from the reactionary box;

a reactionary box bottom plate having a plurality of holes dimensioned and configured to allow the plurality of reactionary pins to project through the reactionary box bottom plate;

the reactionary box bottom plate having a drive hole therethrough, whereby the extension drive socket may mechanically engage the bottom bolt.

6. The hydrant valve removal tool of claim 5, further comprising:

an adaptor having a cylindrical body;

the cylindrical body having a top end and a bottom end, the top end having a top flange having plurality of holes dimensioned and configured to allow the plurality of reactionary pins projecting from the reactionary box bottom plate to further project through the top flange;

the bottom end of the cylindrical body of the adaptor having a bottom flange, the bottom flange having a plurality of holes dimensioned and configured to match such plurality of bolt holes through such hydrant flange; and a plurality of fasteners disposed through the bottom flange and such plurality of bolt holes through such hydrant flange, whereby the adaptor is secured to such hydrant.

7. The hydrant valve removal tool of claim 6, wherein the reactionary box bottom plate drive hole further comprises:

a bushing dimensioned and configured to stabilize the extension drive socket under torsion.

* * * * *